US012698705B2

(12) United States Patent
Shi et al.

(10) Patent No.: US 12,698,705 B2
(45) Date of Patent: Aug. 4, 2026

(54) DOWNHOLE FRACTURING ZONE DATA LOGGER AND DOWNHOLE FRACTURING ZONE DATA ACQUISITION SYSTEM

(71) Applicant: Zhejiang Tensing Science and Technology Co., Ltd., Ningbo (CN)

(72) Inventors: Zhaorui Shi, Ningbo (CN); Bodong Li, Ningbo (CN); Xia Huang, Ningbo (CN); Yangjie Tang, Ningbo (CN)

(73) Assignee: Zhejiang Tensing Science and Technology Co., Ltd., Ningbo (CN)

( * ) Notice: Subject to any disclaimer, the term of this patent is extended or adjusted under 35 U.S.C. 154(b) by 0 days.

(21) Appl. No.: 19/209,662

(22) Filed: May 15, 2025

(65) Prior Publication Data

US 2025/0277440 A1 Sep. 4, 2025

(30) Foreign Application Priority Data

Dec. 5, 2024 (CN) ..... 202423000603.X

(51) Int. Cl.

| | |
|---|---|
| ***E21B 47/06*** | (2012.01) |
| ***E21B 33/128*** | (2006.01) |
| ***E21B 43/26*** | (2006.01) |
| ***E21B 47/07*** | (2012.01) |
| ***E21B 47/135*** | (2012.01) |

(52) U.S. Cl.

CPC ..... *E21B 47/07* (2020.05); *E21B 33/1285* (2013.01); *E21B 43/26* (2013.01); *E21B 47/135* (2020.05); *E21B 2200/08* (2020.05)

(58) Field of Classification Search

CPC ..... E21B 47/06; E21B 47/07; E21B 29/00; E21B 2200/08

See application file for complete search history.

(56) References Cited

U.S. PATENT DOCUMENTS

| | | | | |
|---|---|---|---|---|
| 8,231,947 | B2 * | 7/2012 | Vaidya | C09K 8/80 428/34.1 |
| 8,584,746 | B2 * | 11/2013 | Marya | E21B 29/02 166/376 |
| 9,708,884 | B2 * | 7/2017 | Epstein | E21B 34/063 |
| 10,309,183 | B2 * | 6/2019 | Cutler | E21B 43/261 |
| 10,352,121 | B2 * | 7/2019 | Wise | E21B 47/138 |
| 10,914,163 | B2 * | 2/2021 | Bustos | E21B 47/138 |
| 11,359,449 | B2 * | 6/2022 | Hardesty | E21B 41/00 |
| 11,454,091 | B2 * | 9/2022 | Jacob | E21B 47/10 |
| 11,555,378 | B2 * | 1/2023 | Romer | E21B 33/128 |
| 11,668,186 | B2 * | 6/2023 | Schulte | E21B 33/12 166/250.01 |
| 12,140,016 | B2 * | 11/2024 | Nielsen | E21B 47/017 |
| 12,258,830 | B1 * | 3/2025 | Muhammad | E21B 29/02 |
| 2017/0101843 | A1 | 4/2017 | Waterhouse et al. | |
| 2018/0171749 | A1 | 6/2018 | Yue et al. | |
| 2018/0179853 | A1 | 6/2018 | Yue et al. | |
| 2019/0249520 | A1 * | 8/2019 | Merron | E21B 47/10 |

(Continued)

*Primary Examiner* — Kenneth L Thompson

(57) ABSTRACT

A downhole fracturing zone data logger and a downhole fracturing zone data acquisition system. The data logger includes a sphere, at least one mounting cavity is provided on a surface thereof, a data acquisition module for detecting and acquiring environmental data is provided in the mounting cavity, and an opening of the mounting cavity is provided with a soluble plug for plugging. The data acquisition system can effectively monitor downhole temperature and pressure data.

10 Claims, 5 Drawing Sheets

(56) References Cited

U.S. PATENT DOCUMENTS

| | | | | |
|---|---|---|---|---|
| 2019/0316459 | A1* | 10/2019 | Chen | E21B 43/26 |
| 2020/0370389 | A1* | 11/2020 | Kochanek | E21B 34/14 |
| 2024/0410272 | A1* | 12/2024 | Zhang | E21B 47/138 |

* cited by examiner

DOWNHOLE FRACTURING ZONE DATA LOGGER AND DOWNHOLE FRACTURING ZONE DATA ACQUISITION SYSTEM

TECHNICAL FIELD

The present invention relates to the technical field of petroleum exploration engineering, in particular to a downhole fracturing zone data logger and a downhole fracturing zone data acquisition system.

BACKGROUND

At present, some oil and gas fields have dispersed oil reservoirs and disordered inter-reservoir span, and ordinary fracturing technology can no longer meet the needs of efficient exploitation. In recent years, fracturing bridge plug process has become a core method to solve this problem. At present, the widely used fracturing technique is bridge plug-clustered perforation combination and segmental fracturing. This technique does not need drilling rigs or workover rigs, but adopts cable transmission and hydraulic pumping to carry out bridge plug and multi-stage perforation combination in casing horizontal wells to realize large-volume casing fracturing in horizontal wells. This technique has the advantages of low clast specific gravity, being easy to circulate out of wellbores, and can meet the needs of large-scale staged fracturing of horizontal wells. However, although bridge plugs are widely used as plugging tools on the market at present, they lack real-time monitoring and data acquisition functions, making it difficult to effectively evaluate plugging effect of the bridge plugs and downhole environment status.

SUMMARY

It is an object of the present invention to provide a downhole fracturing zone data logger and a downhole fracturing zone data acquisition system to solve the above-mentioned technical deficiencies.

The present invention provides a downhole fracturing zone data logger, which includes a sphere made of a soluble material, where at least one mounting cavity is provided on a surface of the sphere, a data acquisition module for detecting and collecting environmental data is provided in the mounting cavity, and an opening of the mounting cavity is provided with a soluble plug for plugging.

As another aspect, there is provided a downhole fracturing zone data acquisition system, including: a soluble bridge plug placed in a downhole channel and snapped in the downhole channel after the bridge plug is expanded, where a port of the bridge plug facing an entrance of the downhole channel is a positioning port; and a data logger including a soluble sphere and a data acquisition module for detecting and acquiring environmental data, where at least one mounting cavity is provided on the sphere, the data acquisition module is mounted in the mounting cavity, and at least a part of an inner wall of the mounting cavity is close to an outer peripheral wall of the sphere.

Here, a fracturing fluid is continuously injected while the sphere enters the downhole channel, so that the fracturing fluid can push the sphere to reach the positioning port to plug the port of the bridge plug facing the entrance of the downhole channel, and the data acquisition module works to acquire and save the environmental data in the fracturing zone.

The present invention has the following technical effects: the sphere containing the data logger is made of a soluble material, is pushed by the fracturing fluid to one end of the bridge plug to be positioned, the sphere structure is beneficial to moving in the downhole channel, a plurality of mounting cavities are provided on the sphere, and the data acquisition modules are arranged in the mounting cavities, so that the plurality of data acquisition modules can be uniformly distributed on the sphere to improve monitoring accuracy; the bridge plug is also made of a soluble material, which will not cause debris blockage in the downhole channel and facilitate retrieval of the data acquisition module in a bridge plug ball; a plurality of data acquisition modules are arranged in the sphere to measure temperature and pressure at one end of the bridge plug in the downhole channel in real time, and the acquired data can be sent to the ground for real-time monitoring, or can be stored in a memory module in the data acquisition module, and the data acquisition module can be released and retrieved after the sphere is dissolved to analyze the data. Therefore, the present invention can effectively measure the plugging effect of the bridge plug in different downhole working environments and various environmental data, such as temperature and pressure data, which plays an important role in optimizing the plugging and fracturing process.

Figure 1:
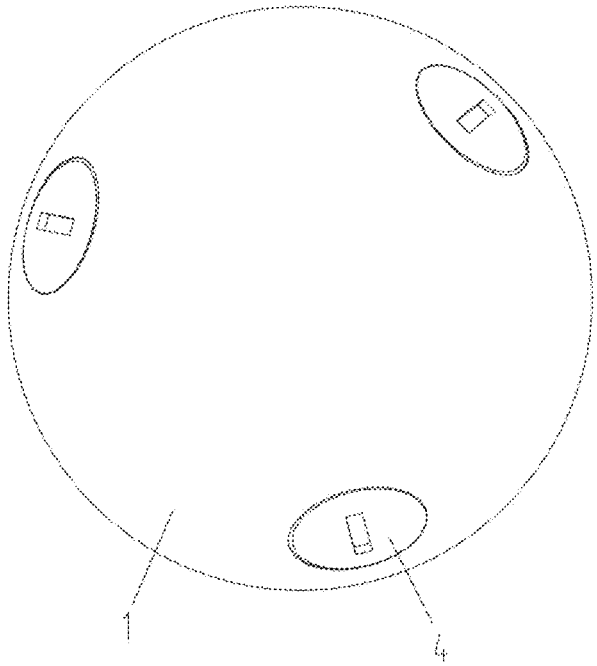
FIG. 1 is an overall structural diagram of a bridge plug ball according to the present invention.
Figure 2:
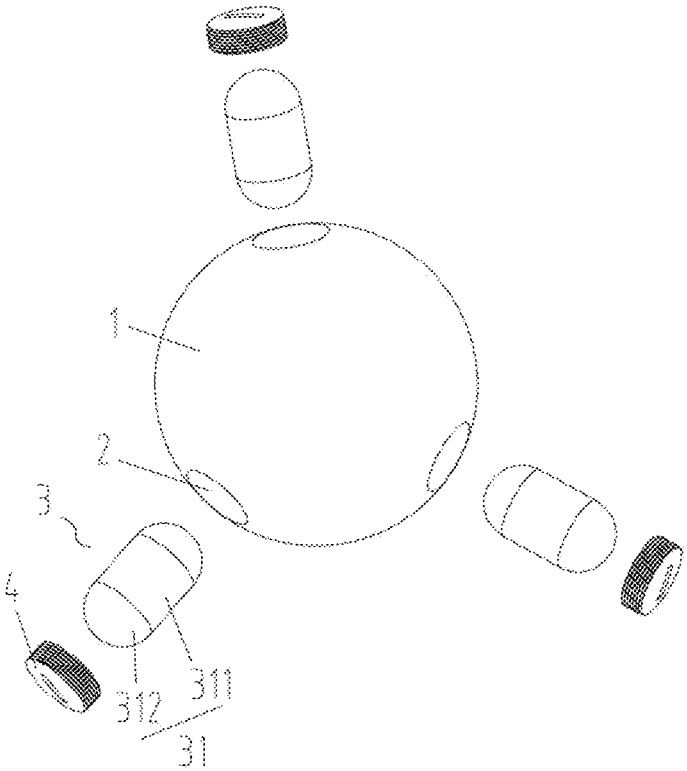
FIG. 2 is a structural exploded view of the bridge plug ball according to the present invention.

Reference numerals in the drawings: 1. sphere; 2. mounting cavity; 3. data acquisition module; 31. housing; 311. cylinder; 312. cover body; 4. plug; 5. bridge plug; 51. positioning port; 6. downhole channel; and 7. crack.

DESCRIPTION OF THE EMBODIMENTS

The technical solutions in the embodiments of the present invention will be clearly and completely described below in conjunction with the accompanying drawings in the embodiments of the present invention. Obviously, the described embodiments are only part but not all of the embodiments of the present invention. All other embodiments obtained by a person of ordinary skill in the art based on the embodiments of the present invention without creative efforts shall fall within the protection scope of the present invention.

The present invention provides a downhole fracturing zone data logger, including a sphere 1, where at least one mounting cavity 2 is provided on a surface of the sphere 1, a plurality of mounting cavity 2, if provided, are uniformly arranged on the surface of the sphere 1, a data acquisition module 3 is provided in each mounting cavity 2, an opening of the mounting cavity 2 is provided with a plug 4 for plugging the opening, the data acquisition module 3 is encapsulated in the mounting cavity 2, and the data acquisition module 3 is configured to detect and acquire environmental data.

The data acquisition module 3 includes a housing 31 for being mounted in the mounting cavity 2; the housing 31 has a transmission module, a battery module, a single chip microcomputer module, a memory module, a transducer module and a wireless charging coil built therein; the battery module, the single chip microcomputer module, the memory module and the transducer module are electrically connected; the wireless charging coil is electrically connected with the battery module; the transmission module includes an infrared receiver and an infrared transmitter, the infrared receiver and the infrared transmitter are electrically connected with the single chip microcomputer module respectively, the infrared transmitter wirelessly transmits data stored in a data memory of the single chip microcomputer module to an upper computer, and the infrared receiver receives control instruction and configuration information for controlling operation of the data acquisition module 3, thus realizing wireless data communication.

The transducer module includes transducers for measuring temperature and pressure in real time, can send the acquired data to the outside in real time for real-time monitoring, and can also save the acquired data in the memory module. The battery module mainly includes a high-temperature battery and a wireless charging function, and wirelessly charges the battery before being put into operation to ensure that the data acquisition module 3 can work continuously for a long time, and the high-temperature battery can adapt to a high-temperature fluid infiltrated into the downhole channel 6 to avoid battery damage due to high-temperature environment.

The single chip microcomputer module is also provided with an indicator light, which provides various indication information to inform the user of corresponding equipment status. Flashing means detection, fast flashing means sending data, and flashing every ten seconds means standby. The indicator light is checked for operating state before putting into operation, checked for sending data after retrieval, and observed for being in operating state after retrieval, etc. These states can be distinguished by different flashing of the indicator light, which facilitates observation.

The structure and working principle of each module are conventional technical means and will not be repeated here. The detected data is stored on the memory module for subsequent download and analysis.

The sphere 1 is made of a soluble material such as a high-temperature and high-pressure resistant resin like polyvinyl alcohol resin or a soluble metal like magnesium-based alloy to achieve solubility and adapt to oil well environments. Different soluble materials can be selected according to actual working conditions.

The plug 4 is made of a soluble material such as soluble rubber or metal like polyurethane rubber to achieve solubility, and the housing 31 is configured to protect the data acquisition module 3. When both the sphere 1 and the plug 4 are dissolved, data can be obtained by retrieving the data acquisition module 3.

A connection between the plug 4 and an inner wall of the mounting cavity 2 may be threaded connection. When the plug 4 is made of a metal, an outer periphery of the plug 4 is provided with external threads, and the inner wall of the mounting cavity 2 is correspondingly provided with internal threads, which further facilitates mounting of the plug 4. When the plug 4 is made of rubber, the plug 4 can be directly inserted into the opening of the mounting cavity 2 to form a tight fit, which also realizes the mounting of the plug 4.

The housing 31 includes a cylinder 311 with openings at both ends or one end, and the opening of the cylinder 311 is detachably connected with a cover body 312, which facilitate mounting/dismounting of the data acquisition module 3 in/from the housing 31.

The housing 31 has an overall capsule shape with hemispherical ends, and the capsule housing 31 facilitates flow and retrieval in the downhole channel 6. A bottom end of the mounting cavity 2 is a hemispherical groove in fit with the hemispherical ends of the housing 31, so that after the housing 31 is vertically inserted into the mounting cavity 2, one end thereof can be positioned with the hemispherical groove, so that the housing 31 can be stably mounted in the sphere 1.

Figure 3:
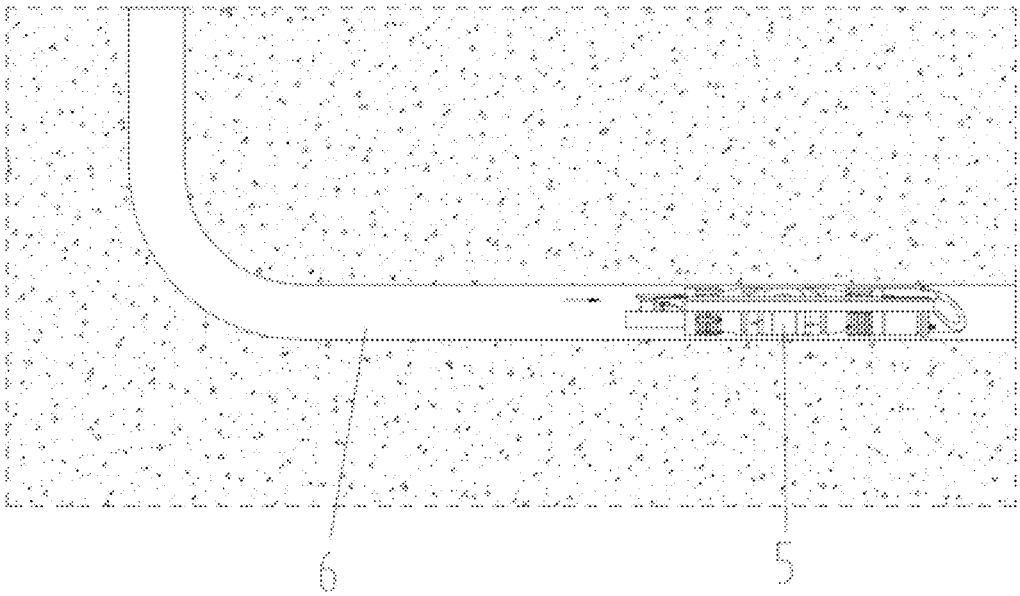
FIG. 3 is a first schematic diagram of a downhole fracturing zone data acquisition system according to the present invention (in a state where the bridge plug is put in)
Figure 4:
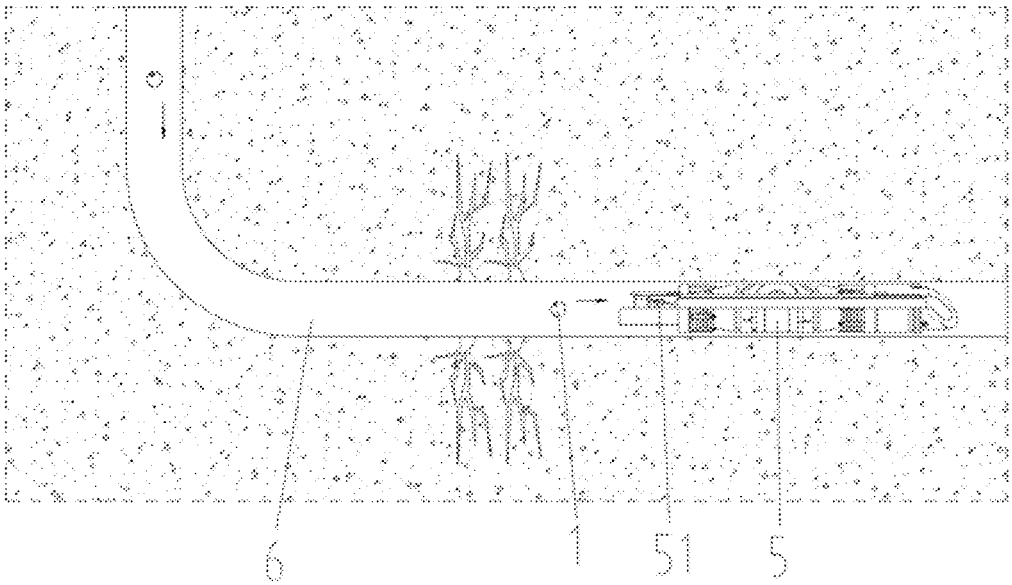
FIG. 4 is a second schematic diagram of the downhole fracturing zone data acquisition system according to the present invention (in a state where the data logger is put in)

The present invention also provides a downhole fracturing zone data acquisition system, which includes a bridge plug 5 and a data logger, where the bridge plug 5 is also made of a soluble material. As shown in FIG. 3, the bridge plug 5 is sent into a downhole channel 6 through a fluid, and then the bridge plug 5 stays at a suitable position and is expanded by an own snap structure and is snapped to an inner wall of the downhole channel 6, and one end of the bridge plug 5 facing an entrance of the downhole channel 6 is a positioning port 51. In the present embodiment, an end portion of the bridge plug 5 forms a funnel-shaped groove, which is through at both ends and serves as a positioning port 51. When the data logger enters the downhole channel 6 from the entrance of the downhole channel 6, as shown in FIG. 4, a fracturing fluid is then injected into the downhole channel 6, and the fracturing fluid will push the data logger to the positioning port 51 of the bridge plug 5, and the data logger will be snapped in the positioning port 51.

Figure 6:
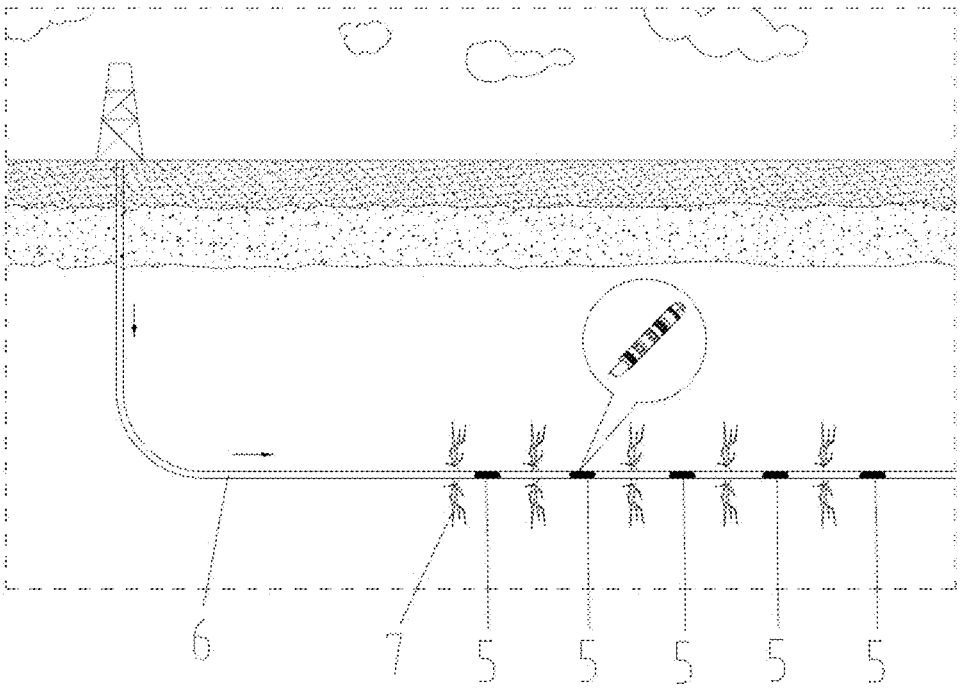
FIG. 6 is a fourth schematic diagram of the downhole fracturing zone data acquisition system according to the present invention (in a state where a multi-section data acquisition zone is formed)

As shown in FIG. 6, a plurality of bridge plugs 5 can be sequentially distributed at intervals in the downhole channel 6, and the data loggers and the bridge plugs 5 are arranged in one-to-one correspondence to form multi-stage data acquisition.

The plurality of data loggers are sequentially numbered in the order of entering the downhole channel 6, making it easy for the data acquisition module 3 to distinguish data from different positions after retrieval.

Figure 8:
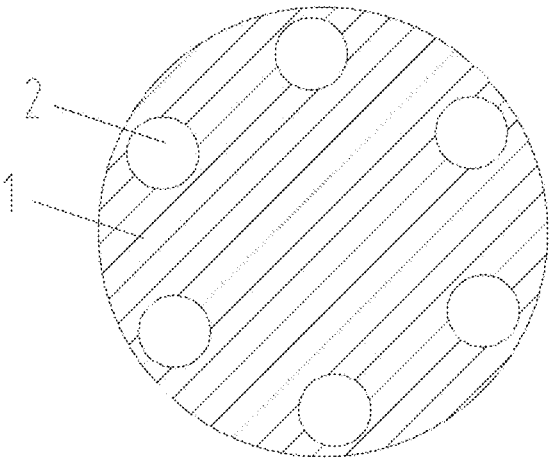
FIG. 8 is a cross-sectional view of a sphere according to the present invention.
Figure 9:
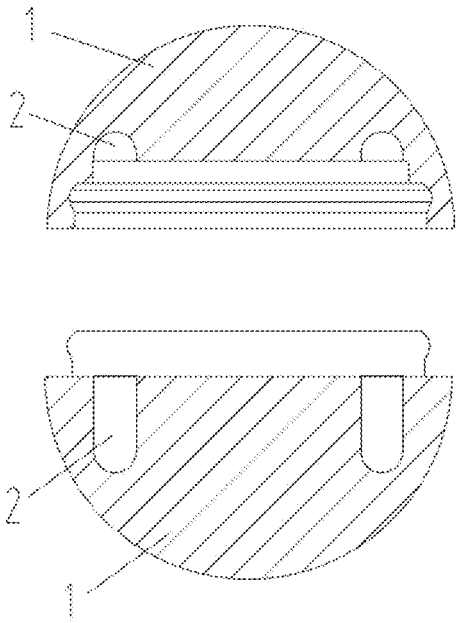
FIG. 9 is a mounting schematic diagram of two hemispheres according to the present invention.

As shown in FIG. 8, the mounting cavity 2 is located inside the sphere 1 and is arranged close to a surface of the sphere 1. As shown in FIG. 9, the sphere 1 can be formed by splicing two hemispheres, and opposite opening edges of the two hemispheres are respectively provided with a snap ring and a snap protrusion, so that the two hemispheres are connected by a buckle to form a complete sphere 1.

Figure 5:
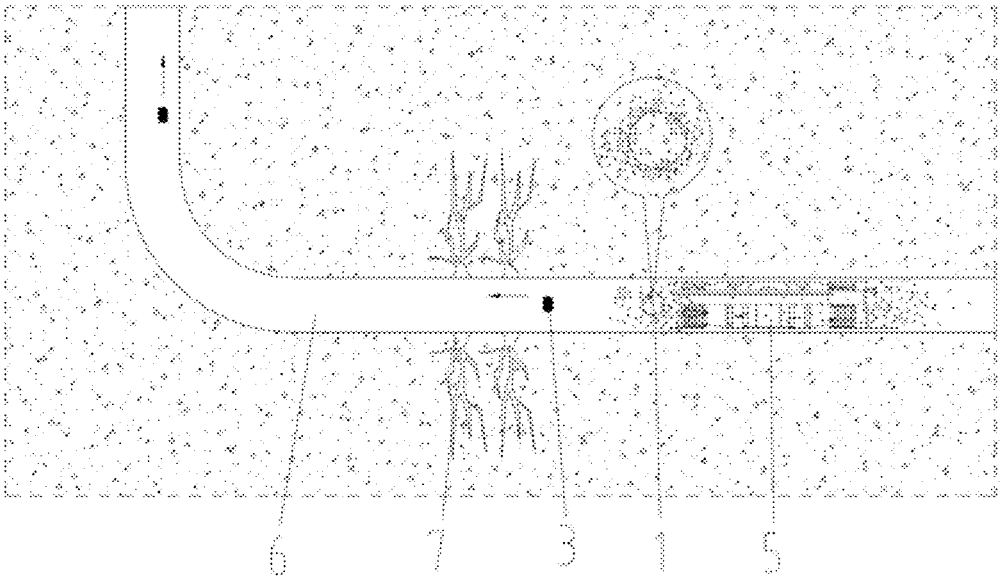
FIG. 5 is a third schematic diagram of the downhole fracturing zone data acquisition system according to the present invention (in a state where the bridge plug and the data logger are dissolved)
Figure 7:
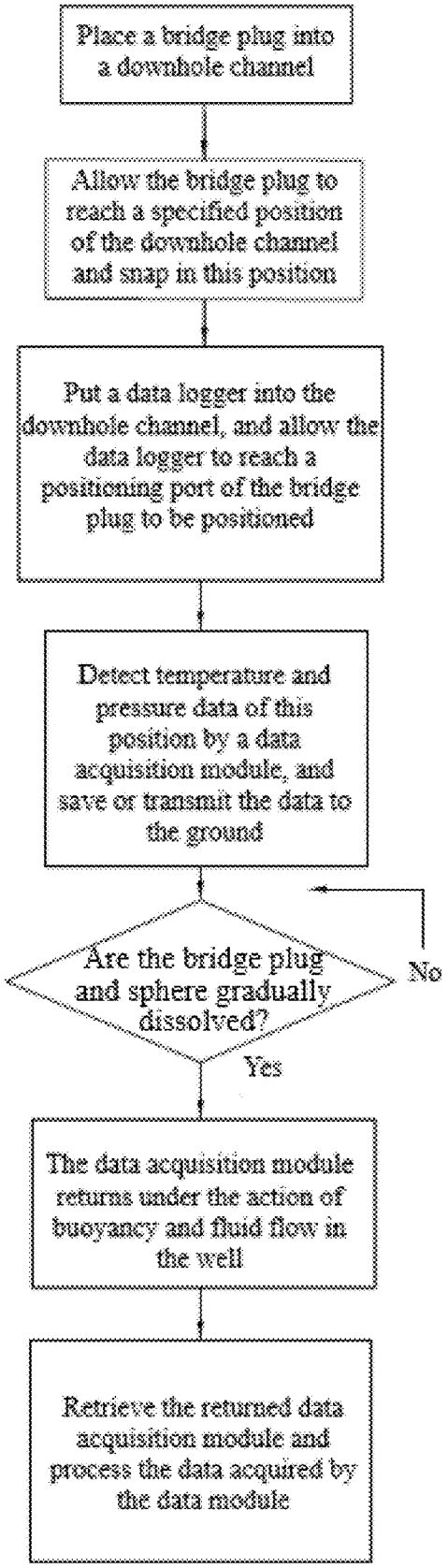
FIG. 7 is an overall workflow diagram of the present invention.

A workflow thereof is as follows: as shown in FIG. 7, firstly, the data acquisition module 3 is loaded into the soluble sphere 1, the downhole channel 6 usually includes a vertical section and a horizontal section, the entrance of the downhole channel 6 is located at one end of the vertical section, the other end of the vertical section is connected with the horizontal section, a drilling apparatus together with the bridge plug 5 is placed at a proper position in the horizontal section of the downhole channel 6, the drilling apparatus drills holes in the inner wall of the downhole channel 6; after drilling, the drilling device is removed from the downhole channel 6; the bridge plug 5 reaches a specified position of the downhole channel 6 and is snapped in the position; the sphere 1 enters the downhole channel 6 while a fracturing fluid is continuously injected; the fracturing fluid is continuously and constantly injected; both ends of the bridge plug 5 are communicated with each other, and the fracturing fluid has a large flow rate after passing through the bridge plug 5, so that the fracturing fluid can push the sphere 1 to reach the positioning port 51 to plug the end of the bridge plug 5 facing the entrance of the downhole channel 6; the data acquisition module 3 works to acquire and save environmental data in the fracturing zone; the bridge plug 5, the data logger and the fracturing fluid are injected again after each injection of the fracturing fluid and the data logger reaches the positioning port 51, so that a plurality of bridge plugs 5 are distributed at intervals in the downhole channel 6, the data loggers and the bridge plugs 5 are arranged in one-to-one correspondence, and the plurality of data loggers are sequentially numbered in the order of entering the downhole channel 6; one bridge plug 5 and one data logger are considered as a unit group, so that a plurality of unit groups are distributed at intervals in the vertical section of the downhole channel 6, and cracks 7 are also distributed at intervals to form multi-stage fracturing cracks 7; since there is a certain distance between two bridge plugs 5, the sphere 3 can smoothly reach the positioning port 51 of the corresponding bridge plug 5 through the fracturing fluid; finally, the plurality of data loggers perform real-time data collection on the environment in each section of the downhole channel 6; and during the acquisition process, the bridge plug 5 and the sphere 1 react with the fracturing fluid in turn and are slowly dissolved. As shown in FIG. 5, after the bridge plug 5 and the sphere 1 of the data logger are completely dissolved, the data acquisition module 3 is protected by the housing 31 and returns to the ground due to own buoyancy and drilling fluid flow.

It should be noted that both the bridge plug 5 and the sphere 1 are made of a soluble material, so that the bridge plug 5 and the sphere 1 can effectively wrap the capsule shaped housing 31 in a solid state for a certain period of time, allowing the data acquisition module 3 in the housing 31 to monitor the downhole environment stably and effectively within that time. The bridge plug 5 and the sphere 1 are sequentially dissolved in the fracturing fluid according to the material dissolution cycle, and finally the housing 31 floats in the fracturing fluid, making it easier to retrieve the housing 31 in the floating state.

What is claimed is:

1. A downhole fracturing zone data acquisition system, comprising:

a soluble bridge plug placed in a downhole channel and snapped in the downhole channel after the bridge plug is expanded, a port of the bridge plug facing an entrance of the downhole channel being a positioning port; and a data logger comprising a soluble sphere and a data acquisition module for detecting and acquiring environmental data, at least one mounting cavity being provided on the sphere, the data acquisition module being mounted in the mounting cavity, and at least a part of an inner wall of the mounting cavity being close to an outer peripheral wall of the sphere; and wherein a fracturing fluid is continuously injected while the sphere enters the downhole channel, so that the fracturing fluid can push the sphere to reach the positioning port to plug the port of the bridge plug facing the entrance of the downhole channel, and the data acquisition module works to acquire and save the environmental data in the fracturing zone.

2. The downhole fracturing zone data acquisition system according to claim 1, wherein the bridge plug, the data logger and the fracturing fluid are injected again after each injection of the fracturing fluid and the data logger reaches the positioning port, so that a plurality of bridge plugs are distributed at intervals in the downhole channel, the data loggers and the bridge plugs are arranged in one-to-one correspondence, and the plurality of data loggers are sequentially numbered in the order of entering the downhole channel;

after the bridge plugs and the sphere of the data logger are dissolved, the data acquisition module floats to the entrance of the downhole channel under the buoyancy of the fracturing fluid; and the data logger located at the entrance of the downhole channel is retrieved to read and analyze data.

3. The downhole fracturing zone data acquisition system according to claim 1, wherein at least one mounting cavity is provided on a surface of the sphere, a data acquisition module for detecting and collecting environmental data is provided in the mounting cavity, and an opening of the mounting cavity is provided with a soluble plug for plugging.

4. The downhole fracturing zone data acquisition system according to claim 3, wherein a plurality of mounting cavities are provided and are uniformly distributed on the surface of the sphere.

5. The downhole fracturing zone data acquisition system according to claim 1, wherein the data acquisition module comprises a housing, and the housing has a transmission module, a battery module, a single chip microcomputer module, a memory module and a transducer module built therein, and the transmission module, the battery module, the memory module and the transducer module are electrically connected with the single chip microcomputer module respectively.

6. The downhole fracturing zone data acquisition system according to claim 5, wherein the transducer module comprises a temperature transducer and a pressure transducer, and the temperature transducer and the pressure transducer are electrically connected with the single chip microcomputer module respectively.

7. The downhole fracturing zone data acquisition system according to claim 5, wherein the data acquisition module comprises a wireless charging coil, and the wireless charging coil is electrically connected with the battery module.

8. The downhole fracturing zone data acquisition system according to claim 5, wherein the transmission module comprises an infrared receiver and an infrared transmitter, and the infrared receiver and the infrared transmitter are electrically connected with the single chip microcomputer module respectively.

9. The downhole fracturing zone data acquisition system according to claim 5, wherein the housing comprises a cylinder with an opening at both ends or one end, and the opening of the cylinder is detachably connected with a cover body.

10. The downhole fracturing zone data acquisition system according to claim 5, wherein the housing has an overall capsule shape with hemispherical ends, and a bottom end of the mounting cavity is a hemispherical groove adapted to the hemispherical ends of the housing; and the plug is made of a soluble rubber or metal, and the sphere is made of a resin.

* * * * *